US005718019A

United States Patent [19]

Cheal

[11] Patent Number: 5,718,019

[45] Date of Patent: Feb. 17, 1998

[54] HINGE DEVICE

[75] Inventor: Jonathon Anthony Paul Cheal, Tamworth, United Kingdom

[73] Assignee: ITW Limited, Windsor, United Kingdom

[21] Appl. No.: 625,856

[22] Filed: Apr. 1, 1996

[30] Foreign Application Priority Data

Apr. 1, 1995 [GB] United Kingdom ..... 9506815

[51] Int. Cl.[6] ..... E05D 11/00

[52] U.S. Cl. ..... 16/388; 16/222; 180/69.21

[58] Field of Search ..... 16/222, 388; 180/69.21, 180/274

[56] References Cited

U.S. PATENT DOCUMENTS

| | | | |
|---|---|---|---|
| 3,599,743 | 8/1971 | Hull | 180/69.21 |
| 3,643,755 | 2/1972 | Gionet et al. | 180/69.21 |
| 3,815,176 | 6/1974 | Porter | 180/69.21 |
| 3,828,885 | 8/1974 | Eissinger et al. | 180/69.21 |
| 4,727,621 | 3/1988 | Emery et al. | 180/69.21 |
| 5,173,991 | 12/1992 | Carswell | 16/82 |

*Primary Examiner*—Chuck Mah
*Assistant Examiner*—Donald M. Gurley
*Attorney, Agent, or Firm*—Schwartz & Weinrieb

[57] ABSTRACT

A hinge device is provided comprising a first member (12) pivotally connected about a hinge axis (14) to a second member (16), an implement to permit radial movement of the hinge axis (14) upon the application of a force to the members, and a locking assembly on at least one of the members to enable inter-engagement of the members to prevent pivotal movement therebetween when the force is applied. The locking assembly is provided by a projection (30) formed in one member and engageable in the other member. The hinge device is particularly of use in attaching a hood along its rear edge to a car body, in which one member is attached to the hood and the other member is attached to the car body.

20 Claims, 3 Drawing Sheets

HINGE DEVICE

FIELD OF THE INVENTION

This invention concerns hinge devices, more particularly hinges for use with motor vehicles, especially locking hinges for hoods of motor vehicles.

BACKGROUND OF THE INVENTION

In order for new motor vehicles to be approved for public use, it is necessary for them to pass a number of stringent safety tests. One of these tests is the so-called 30 mph Front End Impact test, in which a test vehicle is driven into a concrete wall at a speed of 30 mph. Under such test conditions it is common for the car hood, (which is usually hinged about its rear edge to the bulkhead beneath the windshield, to pivot about its hinges, usually bending about its middle between the front and rear edges, and ending up in the shape of an inverted V.

It will be shortly proposed to adopt a more stringent safety test in which the test vehicle is impacted across only half of its frontal width, thus simulating an offset head-to-head collision, which is known to be a far more common form of accident than a full head-on collision. The result of such an impact is that the hood often becomes detached at one or both of its hinges and penetrates the front windshield, with all the attendant dangers of flying glass to the car's occupants.

Attempts have been made to prevent such penetration of the windshield by the front hood. One proposal has involved introducing a hook arrangement onto the rear of the hood so as to prevent detachment thereof. However, none of the solutions so far proposed have proved to be 100% reliable.

OBJECT OF THE INVENTION

It is an object of the present invention to provide an improved hinge particularly for motor vehicle hoods which will reduce the aforenoted risk of detachment.

SUMMARY OF THE INVENTION

According to the present invention there is provided a hinge device comprising a first member pivotally connected about a hinge axis to a second member, compliance means to permit radial movement of the hinge axis upon the application of a force to the members, and locking means on at least one of the members to enable inter-engagement of the members to prevent pivotal movement therebetween.

The compliance means may permit radial movement of the hinge axis upon the application of the force to the members at one angular position thereof, and the locking means enable inter-engagement of the members at the angular position so as to prevent pivotal movement therebetween.

The members may inter-engage each other so as to subtend an angle to the horizontal.

The locking means may comprise a projection formed in one member and engageable in the other member.

Preferably the locking means is a stepped protrusion or hook formed in one member, and a complementary detent or aperture formed in the other member to receive the hook.

If desired the hinge device may be provided with more than one such locking means.

The compliance means preferably comprises a spring.

The hinge axis may be formed by a pivot pin. Where a pivot pin is used, the spring may be looped so as to engage the pin.

Advantageously the pivot pin passes through a slot formed in one member, and the spring is housed at one end of the slot. When constructed in this manner, the invention is of particular application as a hinge for attaching an automobile hood along its rear edge to a car body, in which event the slot is advantageously downwardly inclined in a rearward direction, such that in the event of a frontal impact the rear edge of the hood is forced to move downwardly in response to relative movement of the two hinge members, thereby reducing the risk of the hood rear edge or corner rising up and damaging the windshield.

In use as a car hood hinge, the present invention will therefore cause the hood bonnet to become locked if the hood is pushed rearwardly due to a frontal impact, thus preventing subsequent pivotal movement of the hood and reducing the chance of detachment of the hood from the vehicle bulkhead.

An important advantage of the invention resides in the fact that this design of the hinge device allows the normally thicker material section of the hinge members to become an integral part of the vehicle crash protection system. Since the member secured to the hood may be of a significant length, there is a correspondingly shorter portion of the hood which is unrestrained in the event of a crash. Thus the hood itself can be thought of as a structural part of the vehicle.

The inclined slot may be disposed in either the member attached to the hood or the member attached to the car body.

The spring may be made of sufficient stiffness such that in the event of only a slight frontal impact, the spring will not be permanently deformed, and will return the hinge pin to its original operating position, so that the hood can be opened and shut as normal.

The spring may also be arranged to provide a predetermined resistance torque to the hinge. This feature is of particular benefit in an automated automobile production process in that, after the fixed hinge member has been attached to the vehicle, the hood can be more easily secured to the movable member, the spring resisting the tendency for the hinge to close under gravity.

The compliance means may, alternatively, comprise a deformable hinge. This may take the form of a circular hole in one member for receiving the pivot pin, with the proximal area of the hole being weakened, as by removal of material from adjacent the hole, so that a force on the pin in the direction of the weakened area will cause the weakened area to collapse, resulting in a shift of the hinge axis to enable the locking means to operate.

Although this latter arrangement constitutes a cheaper alternative, it results in a permanent deformation of one of the hinge members, so that the hood cannot readily be opened again. Additionally it is more difficult to provide a predetermined resistance torque with this arrangement.

BRIEF DESCRIPTION OF THE DRAWINGS

The invention will now be described, by way of example, with reference to the accompanying drawings in which like reference characters designate like or corresponding parts throughout the several views and wherein.

DETAILED DESCRIPTION OF THE ILLUSTRATED EMBODIMENTS

Figure 1:
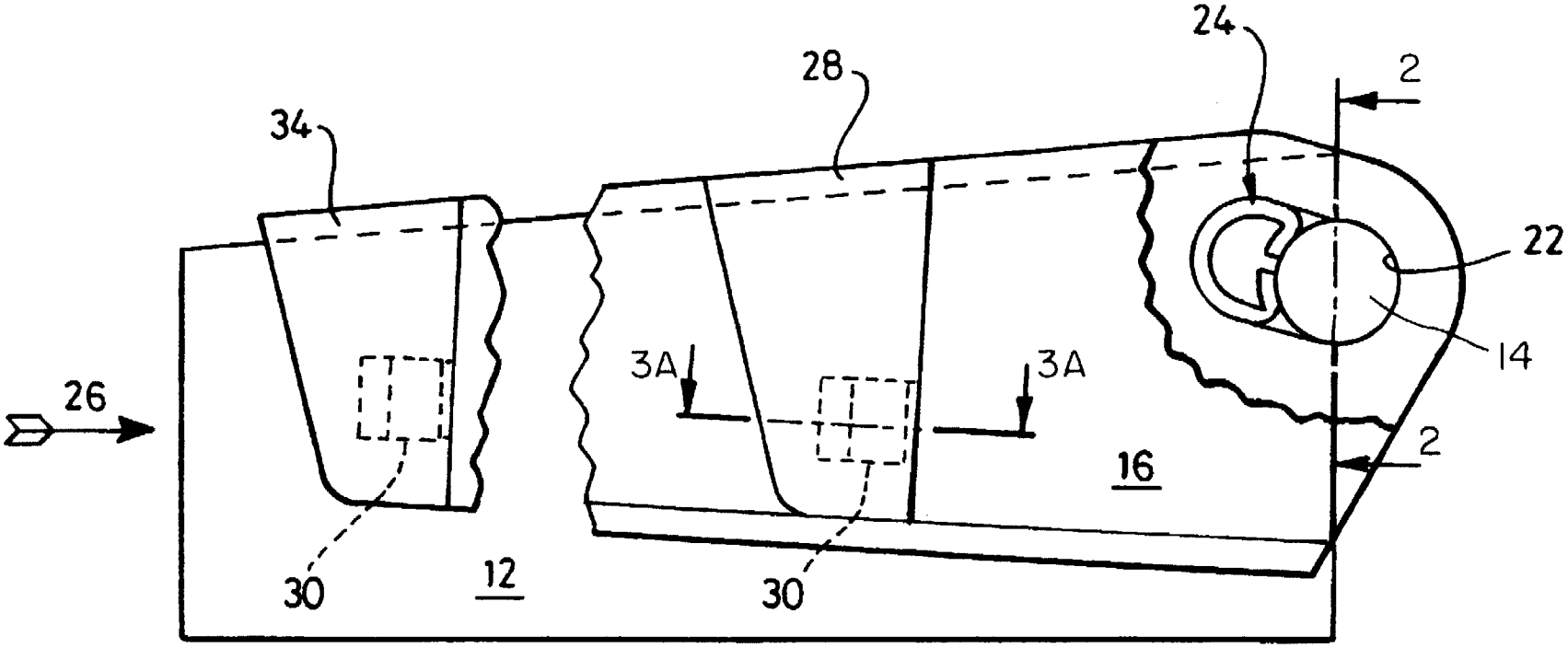
FIG. 1 is a side view of a hinge device in accordance with the invention, in particular for use with the hood of a motor vehicle.
Figure 1A:
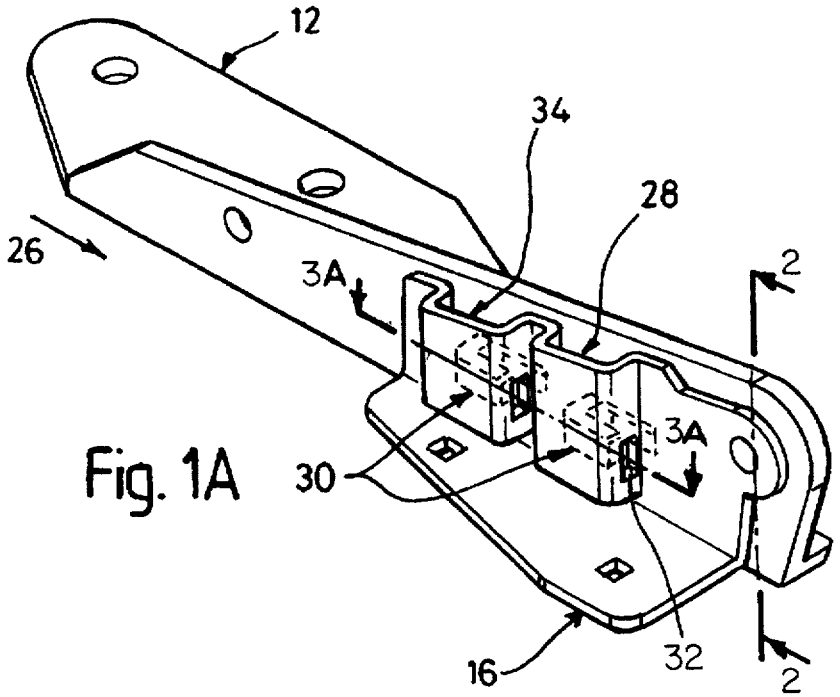
FIG. 1A is a perspective view of the hinge device of FIG. 1.
Figure 2:
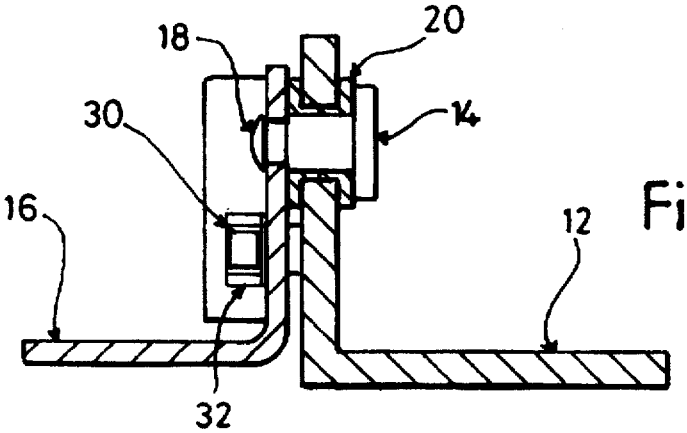
FIG. 2 is an enlarged sectional view of a hinge pin taken along the line 2—2 in FIGS. 1 and 1A, FIGS. 3A and 3B are enlarged sectional views of the locking means taken along the line 3A—3A in FIGS. 1 and 1A, showing the hinge device respectively in the unlocked and locked positions.

Referring first to FIGS. 1, 1A and 2, there is shown a hinge device assembly embodying the invention and comprising essentially a movable hinge member in the form of a bracket 12 of L-section, connected by a pivot pin 14 to a fixed hinge member in the form of a bracket 16 also of L-section. The fixed bracket 16 is secured to the vehicle body, whilst the movable bracket 12 is secured to the underside of the inner skin of the vehicle hood.

As shown, the pivot pin 14 comprises a flanged pin passing through the two brackets 12 and 16 and having a threaded end to which is secured a nut 18 engageable with one side of the fixed bracket 16. The pin 14 and nut 18 can alternatively be replaced by a rivet. Mounted on the pin 14 is a pair of opposed bushes 20 which fit into, and normally engage in, one end of an elongated aperture or slot 22 formed in the movable bracket 12. The slot 22 is downwardly inclined to the right, as viewed in FIG. 1. Located at the other end of the slot 22 is a D-shaped spring 24 engageable radially against the bushes 20.

When a predetermined force is applied to the bracket 12 from the right, as shown by the arrow 26, the spring 24 is adapted to deflect. The bracket 12 is thus capable of moving to the right, sliding on the bushes 20 of the pin against the spring 24.

Figure 3A:
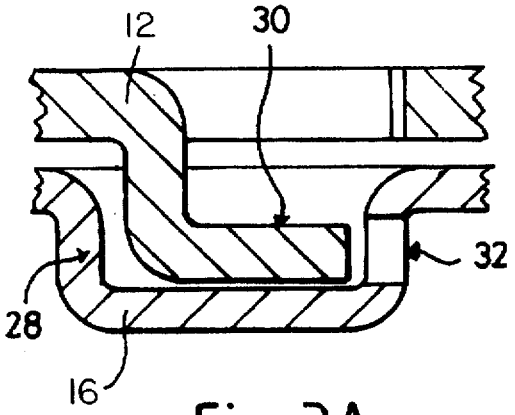

Referring now to FIG. 3A, the upper limb of the bracket 16 is provided with an outward deformation 28. A stepped protrusion in the shape of a claw or hook 30 is formed in the movable bracket 12 so as to be normally freely movable into and out of the deformation during opening and closing of the hinge. In the closed position of the hinge, as shown, the free end of the hook 30 is aligned with an aperture 32 in one side of the deformation 28.

Figure 3B:
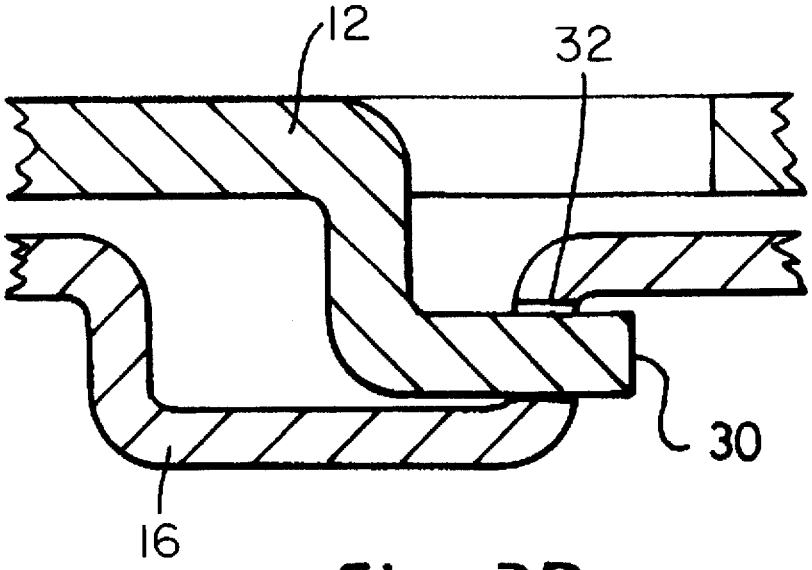

When, fitted to a vehicle, should a frontal impact occur, particularly an offset frontal impact, the bracket 12 is pushed to the right, as viewed in FIG. 1, causing the spring 24 to become compressed and the leading end of the hook 30 to act as a bolt and engage in the aperture 32, as shown in FIG. 3B, so that the hinge assembly thereafter becomes locked.

A second deformation 34 and corresponding aperture, similar to 32 but not numbered, is formed in the bracket 12 towards its left-hand end, enabling a second hook 30 formed in the movable bracket 12 to engage therein, thus reinforcing the locking of the hinge assembly.

Due to the downward inclination of the aperture 22, the rear-most edge of the hood will, in the event of an impact, be shifted downwards as it is forced rearwards, thereby reducing the risk of damage to the windshield of the vehicle.

Figure 4:
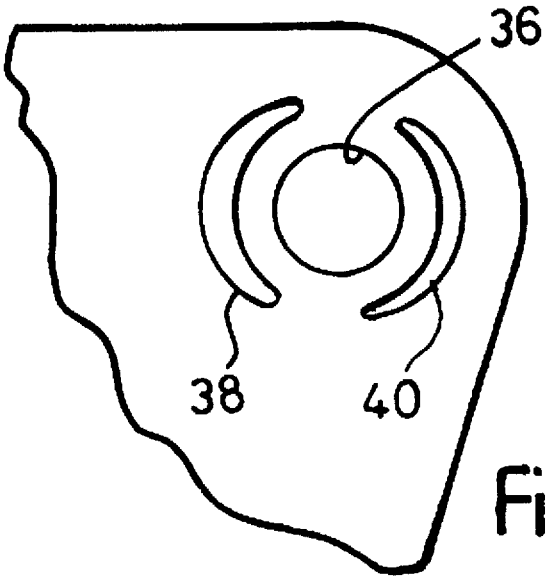
FIG. 4 represents a modification of the hinge of FIG. 1.

FIG. 4 shows a modification to the hinge device assembly described with reference to FIGS. 1 to 3. Thus FIG. 4 shows an alternative to the slot 22 and spring 24. Here the hole 36 for the pivot pin is circular, and two arcuate slots 38 and 40 are formed by removing metal from each side of the hole 36. When an impact occurs the pin will crush the material, collapsing the right-hand slot 40 and enabling locking of the hinge assembly to occur. However, in this case the collapse and resulting distortion is permanent, so that the hinge assembly will remain locked and unuseable thereafter.

Although the hinge device described herein is of particular application to vehicle hoods, it may also find application to other areas of a vehicle. For example, a similar, though less serious, situation can occur in the event of a so-called rear end accident, in which case the present hinge device, when fitted to the trunk lid, could also prove beneficial in reducing damage for example to the rear window of the vehicle.

Equally, the hinge device described herein may be used for attaching the rear seats of hatchbacks or estate cars to the floors of such vehicles.

Furthermore, the hinge device described could be used in certain security locks, or in furniture, or indeed in any pivotal arrangement which would benefit from a locking action when subjected to a force.

I claim:

1. A hinge device, comprising:

a first member;

a second member;

pivot means pivotally connecting said second member relative to said first member about a pivot axis;

means for permitting substantially linear movement of said second member relative to said first member and said pivot means upon application of a predetermined force to said second member; and locking means defined between said first and second members for preventing pivotal movement between said first and second members when said second member is moved linearly, relative to said first member and said pivot means when said predetermined force is applied to said second member.

2. A hinge device according to claim 1, wherein:

said means for permitting movement of said second member permits radial movement of said second member, with respect to said pivot axis upon the application of said predetermined force to said second member, at a predetermined angular position of said second member with respect to said first member; and said locking means enables inter-engagement of said first and second members at said predetermined angular position so as to prevent pivotal movement therebetween.

3. A hinge device according to claim 1, wherein:

said first and second members inter-engage each other at a predetermined angle with respect to a horizontal plane.

4. A hinge device according to claim 1, wherein:

said locking means comprises a projection formed upon one of said first and second members and an aperture, engageable said projection, formed within said other one of said first and second members.

5. A hinge device according to claim 1, wherein:

said locking means comprises a stepped protrusion formed upon one of said first and second members, and a complementary detent formed within said other one of said first and second members so as to receive said protrusion.

6. A hinge device according to claim 5, wherein:

said locking means comprises a pair of stepped protrusions and complementary detents.

7. A hinge device according to claim 1, wherein in said means for permitting movement of said second member comprises:

an elongated slot defined within said second member;

said pivot means is normally disposed within one end of said elongated slot; and a compressible spring is interposed between an opposite end of said elongated slot and said pivot means, whereby upon application of said predetermined force to said second member, said second member will be permitted to undergo said substantially linear movement with respect to said first member by compressing said compressible spring.

8. A hinge device according to claim 7, wherein:

said pivot axis is defined by a pivot pin.

9. A hinge device according to claim 8, wherein:

said spring is looped so as to engage said pivot pin.

10. A hinge device according to claim 7, wherein:

said first member is adapted to be attached to an automobile body, and said second member is adapted to be attached to a rear edge portion of an automobile hood so as to hingedly mount said automobile hood upon said automobile body.

11. A hinge device according to claim 10, wherein:

said slot is inclined downwardly in a rearward direction such that said rear edge portion of said hood is forced to move downwardly in response to relative movement between said first and second hinge members.

12. A hinge device according to claim 7, wherein:

said compressible spring is of sufficient stiffness such that in the event of only a slight force being impressed upon said second member, said compressible spring is not permanently deformed and returns said second member to its original operating position.

13. A hinge device according to claim 1, wherein:

said means for permitting said movement of said second member comprises a deformable hinge assembly.

14. A hinge device according to claim 13, wherein:

said deformable hinge assembly comprises a circular aperture formed within said second member for receiving said pivot means, and wherein an area of said second member proximal to said aperture is weakened so that said predetermined force applied to said second member will cause said weakened area of said second member to collapse resulting in said substantially linear movement of said second member with respect to said first member and said pivot axis defined by said pivot means so as to enable said locking means to operate.

15. A hinge device, comprising:

a first member;

a second member;

pivot pin means for pivotally mounting said second member upon said first member about a pivotal hinge axis;

means operatively associated with said pivot pin means for permitting substantially linear movement of said second member with respect to said first member and said pivot pin means, upon the application of a predetermined force to said second member, between a first position at which said second member is able to pivot about said pivotal hinge axis with respect to said first member, and a second position at which said second member is unable to pivot about said pivotal hinge axis with respect to said first member; and locking means defined between said first and second members for permitting said second member to undergo pivotal movement with respect to said first member when said second member is disposed at said first position with respect to said first member, and for preventing pivotal movement of said second member with respect to said first member when said second member is disposed at said second position with respect to said first member.

16. A hinge device as set forth in claim 15, wherein said means for permitting movement of said second member comprises:

an elongated slot defined within said second member for accommodating said pivot pin means within one end of said elongated slot; and compressible spring means disposed within an opposite end of said elongated slot and engaged with said pivot pin for biasing said second member toward said first position with respect to said first member.

17. A hinge device as set forth in claim 16, wherein said locking means comprises:

at least one aperture defined upon said first member at a position remote from said hinge axis; and at least one projection formed upon said second member at a position remote from said hinge axis and adapted for insertion into said at least one aperture of said first member when said second member is moved by said predetermined force from said first position to said second position.

18. A hinge device as set forth in claim 15, wherein:

said first and second members comprise substantially L-shaped brackets for respective connection to an automobile body and a rear edge portion of an automobile hood so as to permit pivotal movement of said hood with respect to said automobile body when said second member is disposed at said first position with respect to said first member, and to lock said first and second members together when said second member is disposed at said second position with respect to said first member such that said rear edge portion of said automobile hood will not impact against a front windshield of said automobile.

19. A hinge device as set forth in claim 15, wherein:

said means for permitting said movement of said second member with respect to said first member comprises a deformable hinge assembly comprising a circular aperture formed within said second member for receiving said pivot pin means, and an area of said second member which is proximal to said aperture and which is weakened so that said predetermined force applied to said second member will cause said weakened area of said second member to collapse resulting in said movement of said second member with respect to said first member and said hinge axis defined by said pivot pin means so as to enable said locking means to operate.

20. A hinge device as set forth in claim 19, wherein:

said weakened area of said second member comprises an arcuate slot portion partially surrounding said circular aperture within which said pivot pin means is disposed.

* * * * *